United States Patent [19]

Rovin

[11] 4,184,652

[45] Jan. 22, 1980

[54] BOBBIN SPOOL

[75] Inventor: Herman Rovin, Norwalk, Conn.

[73] Assignee: Automatech Industries, Inc., Bridgeport, Conn.

[21] Appl. No.: 900,977

[22] Filed: Apr. 28, 1978

[51] Int. Cl.[2] ..... B65H 75/14; B65H 75/28

[52] U.S. Cl. ..... 242/118.2; 242/118.4; 242/118.7; 242/125.1; 242/159

[58] Field of Search ..... 242/125.1, 125, 125.2, 242/18 A, 18 PW, 18 EW, 74, 118.2, 118.4, 118.7, 159, 179, 118.9

[56] References Cited

U.S. PATENT DOCUMENTS

| | | | |
|---|---|---|---|
| 2,904,280 | 9/1959 | Eckels et al. | 242/74 |
| 3,967,795 | 7/1976 | Shindo et al. | 242/125.1 |

FOREIGN PATENT DOCUMENTS

| | | | |
|---|---|---|---|
| 239052 | 3/1965 | Austria | 242/74 |

*Primary Examiner*—George F. Mautz

*Attorney, Agent, or Firm*—Dike, Bronstein, Roberts, Cushman & Pfund

[57] ABSTRACT

A bobbin spool for an automatic sewing machine wherein a predetermined length of thread is wound onto the spool for each sewing operation comprising a hub, spaced parallel flanges at opposite ends of the hub, one of said hubs constituting a turbine wheel by means of which the bobbin may be rotated at a high speed by means of a jet of air and a traction engendering element covering an arcuate portion of the hub.

3 Claims, 8 Drawing Figures

BOBBIN SPOOL

BACKGROUND OF THE INVENTION

In U.S. Pat. No. 3,509,840 and pending applications Ser. No. 833,178, filed Sept. 14, 1977, now U.S. Pat. No. 4,117,789, and Ser. No. 896,884, filed Apr. 17, 1978, there are shown and described bobbin spools for automatic sewing machines wherein a predetermined length of thread is wound onto a spool for each sewing operation. In U.S. Pat. No. 3,509,840, there are a plurality of small diameter wires extending parallel to the axis of the spool and spaced outwardly of the axis for catching the leading end of the thread. In U.S. Pat. No. 4,117,789, the leading end of the thread is entangled and caught by a layer of "fuzzy" material applied to the hub of the spool, for example, a stiff piled fabric or a piece of Velcro. The aforesaid means for entraining the leading end of a thread are quite appropriate for soft thread; however, when stiff, hard and/or slippery threads are used, there is a tendency for the leading end of the thread to slip and fail to be caught for winding onto the spool. It is, accordingly, the purpose of this invention to provide the spool with improved traction-engendering means especially designed to insure catching the leading end of stiff, hard and/or slippery thread.

SUMMARY OF THE INVENTION

As herein illustrated, the invention comprises in combination with a bobbin spool for use with automatic sewing machinery wherein thread is wound onto the bobbin spool by projecting the leading end of the thread onto the bobbin while the latter is rotating at high speed, of friction-engendering means for catching the leading end of the thread so as to cause it to become wound onto the bobbin spool wherein the traction -engendering means is a piece of flexible, thin walltubing attached about a peripheral portion of the hub between the flanges, the surface of which is tacky or which is provided with a tractive surface as, for example, by means of a piece of material attached to the tube which has upstanding therefrom a plurality of closely-spaced nubble, or a piece of material which has a stiff pile surface. The exposed surface is both peripherally and axially convex. The invention will now be described in greater detail with reference to the accompanying drawings, wherein:

Figure 1:
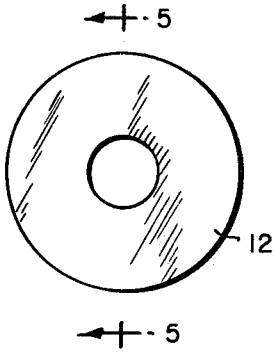
FIG. 1 is an elevation of one side of the bobbin spool of approximately twice the actual size of the spool.
Figure 2:
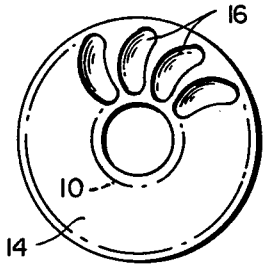
FIG. 2 is an elevation of the opposite side of the bobbin spool.
Figure 3:
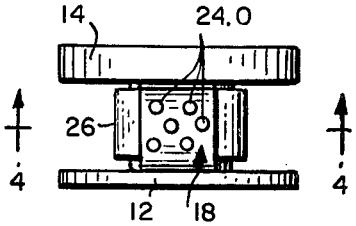
FIG. 3 is a plan view of the bobbin spool showing one form of friction-engendering means on the hub portion thereof.

Referring to the drawings, the spool herein illustrated which is for use with automatic sewing machines comprises a hub portion 10 at the opposite ends of which there are spaced, parallel flanges 12 and 14. The material of which the spool is made may comprise plastic, although it may be comprised of other materials, for example, sheet metal, pressed paperboard and the like.

For use in automatic sewing machines of the kind referred to and as already illustrated in the aforesaid patent and pending applications, one of the flanges, the flange 14, herein illustrated, is provided on its outer surface with a plurality of peripherally-spaced, kidney-shaped recesses 16 which collectively constitute a turbine by means of which the spool is rotated at a high speed by directing a jet of air against the outer surface.

Figure 4:
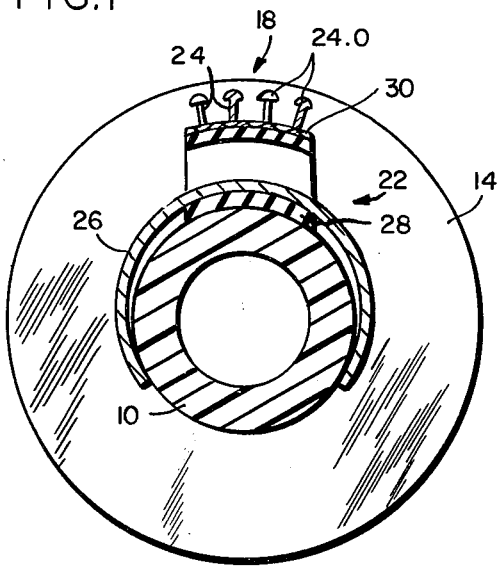
FIG. 4 is a greatly enlarged section taken on the line 4—4 of FIG. 3 showing the traction-engendering means and attachment thereof to the hub of the spool.
Figure 6:
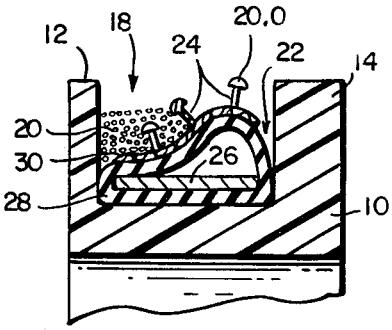
FIG. 6 is a fragmentary section showing how the thread becomes wound onto the spool.
Figure 8:
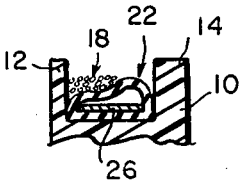
FIG. 8 is a fragmentary section of still another form of traction-engendering means.

In accordance with the invention, the bobbin as thus constructed is provided with friction-engendering means 18 covering an arcuate portion of the hub, as illustrated in FIG. 4, which is yieldably displaceable axially of the hub as shown in FIG. 6 to allow and to promote winding of the thread 20 on a limited portion of the spool in contrast to the winding of the thread on the spools referred to in the aforesaid patent and pending applications where it is distributed quite haphazardly from side to side. The advantage of such concentrated winding as is accomplished herein is that there is less entanglement and, hence, during the sewing operation, the thread is released to the needle with less chance of knotting and/or of breaking.

Figure 5:
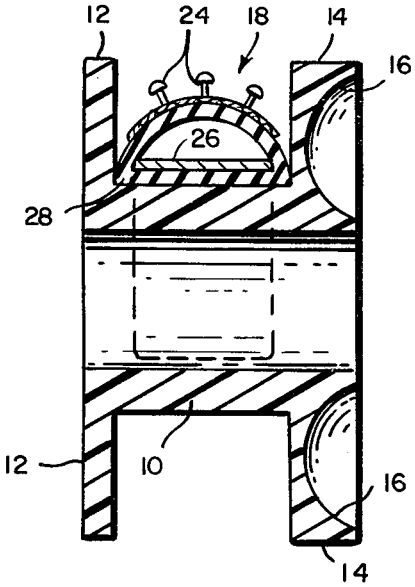
FIG. 5 is a diametral section of the same scale as FIG. 4 taken on the line 5—5 of FIG. 1.

The friction-engendering means 18 is comprised of a short length of flexible thin wall tubing 22 having on one surface a plurality of slender, flexible, randomly-arranged nubble 24 which stand outwardly therefrom and are densely enough distributed so that the leading end of the thread projected against the surface will become entangled between the stems of the nubble. The upper ends of the nubble may have heads 24.0. The flexible tubing 22 is secured to the hub 10 of the spool by means of a spring clip 26 which is threaded through the tube so as to bend the tube longitudinally about the hub, as shown in FIG. 4, and to press the lower side 28 of the tube arcuately about the hub, as shown in FIGS. 5 and 6. The upper side of the tube, as shown in FIG. 5, is transversely convex and the nubble stand upwardly therefrom away from the convex surface and are distributed thereon both transversely and circumferentially.

In operation, when the leading end of a thread is projected into the bobbin case against the rapidly rotating bobbin, the end tends to, and does, oscillate from side-to-side at a very rapid rate and becomes entangled betwen the stems of the nubble and is caught thereby and wound onto the spool. As the winding proceeds, the tension in the yarn collapses the supporting tube which is of thin-walled construction and quite flexible to one side or the other so that the thread becomes wound and stored up at one side of the spool as shown in FIG. 6.

The nubble 24 is provided by adhesively attaching a piece of Velcro 30 to the surface of the thin wall flexible tube 22, the pile surface of which has been treated to provide the enlargements or heads 24.0. Alternatively, a piece of conventional Velcro 32 may be employed as shown in FIG. 7 wherein the upper ends of the pile have barbs or hooks 34 or a piece of stiff pile fabric.

Figure 7:
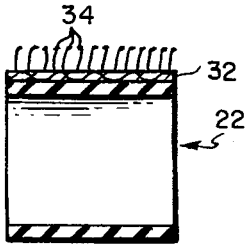
FIG. 7 is a section of alternative traction-engendering means.

It has been found that the gum rubber tube is sufficient tacky so that it will hold the thread to the hub long enough to start the winding operation without the aid of the pieces 30 and 32 of FIGS. 4 and 7 and so it is within the scope of the invention to employ a piece of gum rubber tubing as the sole friction-engendering means. Over extended periods of use, the tacky surface of the tube tends to become less tacky by accumulation of dirt and/or fibers and it is for this reason that the structures disclosed in FIGS. 3 to 7 are preferred.

The gum rubber tubing has been described as of thin wall construction and for the purpose of this invention as shown in each of the several forms of the invention, is in the order of 0.030–0.040 inches in wall thickness.

It should be understood that the present disclosure is for the purpose of illustration only and includes all modifications or improvements which fall within the scope of the appended claims.

I claim:

1. A bobbin spool for an automatic sewing machine of the self-loading type comprising a hub, spaced parallel flanges at opposite ends of the hub, a thin wall tube of gum rubber wrapped part way around the hub, and a spring clamp disposed about the hub with a portion thereof intermediate its ends extending through the tube.

2. A bobbin spool according to calim 1, wherein said spring clamp is of such width as to crowd the underlying wall of the tube into the corners at the insections of the flanges with the ends of the hub.

3. A bobbin spool according to claim 1, wherein the unconstrained tube defines a transversely arcuate surface between the flanges which at its opposite sides is substantially tangent to the inside surfaces of the flanges.

* * * * *